United States Patent [19]

Nutting

[11] Patent Number: 5,035,032

[45] Date of Patent: Jul. 30, 1991

[54] CARDBOARD COFFIN

[76] Inventor: Donald W. Nutting, 1295 Ithaca Dr., Boulder, Colo. 80303

[21] Appl. No.: 505,728

[22] Filed: Apr. 6, 1990

[51] Int. Cl.[5] ..... A63G 17/00

[52] U.S. Cl. ..... 27/4; 27/7

[58] Field of Search ..... 27/4, 7

[56] References Cited

U.S. PATENT DOCUMENTS

| | | |
|---|---|---|
| 3,969,798 | 7/1976 | Sahlin . |
| 4,151,630 | 5/1979 | Havey . |
| 4,156,956 | 6/1979 | Partridge et al. . |
| 4,170,054 | 10/1979 | Ruffner et al. . |
| 4,399,596 | 8/1983 | Parlour et al. . |
| 4,891,869 | 1/1990 | Nutting . |

FOREIGN PATENT DOCUMENTS

| | | |
|---|---|---|
| 2013739 | 10/1971 | Fed. Rep. of Germany . |
| 531812 | 9/1953 | Italy . |
| 7907743 | 10/1979 | Netherlands . |
| 8204186 | 12/1982 | PCT Int'l Appl. ..... 27/4 |
| 1183329 | 3/1970 | United Kingdom . |

*Primary Examiner*—Richard E. Chilcot, Jr.

*Attorney, Agent, or Firm*—Klaas & Law

[57] ABSTRACT

A cardboard coffin is constructed from a blank cut from a sheet of corrugated cardboard having a predetermined width wherein the blank has a central body portion, a longitudinal axis and a perimeter defined by linear score lines having integral generally rectangularly shaped portions extending therefrom and each of which is provided with a pair of spaced apart score lines for defining an edge portion when folded about the spaced apart score lines. The linear score lines defining the central body portion include a pair of relatively short linear score lines and a pair of relatively long linear score lines which are inclined at different angular relationships to the longitudinal axis and both pairs having segments of their edge portions in parallel relationship so that the central body portion can have a greatest width in relation to the predetermined width of the sheet from which it is cut.

11 Claims, 2 Drawing Sheets

CARDBOARD COFFIN

FIELD OF THE INVENTION

This invention relates generally to novelty products for forming such novelty products for use at parties and conventions and more particularly to a cardboard coffin.

BACKGROUND OF THE INVENTION

It is common practice, particularly during the fall and winter seasons of the calendar year, to have masquerade parties where people dress in costumes which are often fantastic. At some of these parties, there is provided a coffin in which a person costumed as a vampire, monster or skeleton, will pretend to be dead and then arise from the dead at contemplated intervals with or without a lid. However, the use of a lid is more effective. Since the costs of an actual coffin are so high, imitation coffins have been marketed for use at such parties. Such imitation coffins have generally been still too expensive or of a construction which is not durable, too small and/or they do not have structures which permit the performance of many functions which the person masquerading as a vampire, master or skeleton, would like to perform. Therefore, there exists a need for a durable and functional imitation coffin for use at parties or conventions as described above. It is also desirable that the coffin at the shoulder area of the person in the coffin be as large as possible. Since the sheet of cardboard comes in a standard width, this presents a problem. Also, it is desirable that the exposed edge portions of the coffin give an appearance of a true thickness. Without a lid, this designed coffin may be used more passively with only an inanimate body (or no body, impressive merely by the large size of the coffin).

BRIEF DESCRIPTION OF THE INVENTION

This invention provides a cardboard blank for forming the central body portion and sidewalls of a coffin wherein the blank is dimensioned so that the central body will have the greatest width possible when the blank is cut from a sheet of corrugated cardboard or other material having similar characteristics wherein the sheet has edge portions defining a predetermined width. Also, the sidewalls are formed from rectangularly shaped portions integral with the central body portion which rectangularly shaped portions are provided with spaced apart score lines so that an edge portion is formed between the spaced apart score lines when the integral rectangularly shaped portions are folded around the spaced apart score lines.

In a preferred embodiment of the invention a coffin is constructed from a blank cut from a sheet of a material having edge portions defining a predetermined width and selected from the group comprising cardboard, corrugated cardboard, fiber board or other materials having similar characteristics. The blank comprises a central body portion having a length greater than its width and a lengthwise extending longitudinal axis and wherein the central body portion has a perimeter defined by a plurality of linear score lines comprising a pair of spaced apart parallel linear score lines extending in a direction transverse to the longitudinal axis, a pair of spaced apart relatively short linear score lines extending in a direction inclined to the longitudinal axis and a pair of spaced apart relatively long linear score lines extending in a direction inclined to the longitudinal axis. A plurality of integral generally rectangularly shaped portions extend from the perimeter of the central body portion so that each of the integral rectangularly shaped portions may be folded around one of the linear score lines to form sidewalls for the coffin. Each of the plurality of generally rectangularly shaped portions has at least one score line which is parallel to one of the linear score lines defining the perimeter of the central body portion so that each of the generally rectangularly shaped portions may be folded around the at least one score line to form juxtaposed sections. Each of the integral generally rectangularly shaped portions has an exposed edge portion with the exposed edge portions of the integral generally rectangularly shaped portions extending from the pair of relatively long linear score lines having linear segments thereof in a parallel relationship with each other and coinciding with the edge portions defining the predetermined width of the sheet of material to provide the central body portion with as greatest width as possible from the predetermined width of the sheet of material and the exposed edge portions of the generally rectangularly shaped portions extending from the pair of relatively short linear score lines having linear segments thereof in a parallel relationship with each other and coinciding with the edge portions defining the predetermined width of the sheet of material to provide the central body portion with as greatest width as possible from the predetermined width of the sheet of material. At least some of the plurality of integral rectangularly shaped portions have score lines defining integral lateral extensions so that when the blank is folded around the score lines, each of the integral lateral extensions will be located between the juxtaposed sections of a next adjacent one of the rectangularly shaped portions. Fastening means are provided for securing one of the lateral extensions between the next adjacent one of the juxtaposed sections so that all of the folded integral rectangularly shaped portions are held in the folded relationship and wherein the fastening means comprise one of the lateral extensions having an opening formed therein, the next adjacent one of the folded juxtaposed sections having openings formed therein and aligned with the opening in the one lateral extension and the fastening means extending through the aligned openings. In the preferred embodiment, the at least one score line in each of the integral rectangularly shaped portions comprises a pair of spaced apart linear score lines to that an edge portion is formed between the spaced apart score lines when the integral rectangularly shaped portions are folded around the spaced apart score lines.

Another cardboard blank is provided for forming a lid for the cardboard coffin and comprises a flat cardboard sheet having a central body portion, having a length greater than its width and a lengthwise extending longitudinal axis, and having a perimeter defined by a plurality of linear score lines similar to but slightly larger than the perimeter of the central body portion of the coffin. A plurality of integral generally rectangularly shaped portions extend from the perimeter of the central body portion of the lid so that each of the integral rectangularly shaped portions may be folded around one of the linear score lines to form sidewalls for the lid. Mounting means are provided for hingedly mounting one of the sidewalls of the lid on one of the sidewalls of the coffin so that the lid may be readily moved between closed or opened positions. A plurality of the plurality of integral generally rectangularly shaped portions for forming the sidewalls of the lid having at least one score line parallel to one of the linear score lines defining the perimeter of the central body portion of the lid so that each of the plurality of the plurality of the integral generally rectangularly shaped portions may be folded around the at least one score line to form juxtaposed sections. At least some of the plurality of integral generally rectangularly shaped portions of the lid have score lines defining integral lateral extensions so that when the blank is folded around the score lines, each of the integral lateral extensions will be located between the juxtaposed sections of a next adjacent one of the integral generally rectangularly shaped portions. Fastening means are provided for securing one of the integral lateral extensions between the next adjacent one of said juxtaposed sections so that all of the folded integral generally rectangularly shaped portions are held in the folded relationship; and wherein the fastening means comprise one of the integral lateral extensions having an opening formed therein, the next adjacent one of the folded juxtaposed sections having openings formed therein and aligned with the opening in the one integral lateral extension and fastening means extending through the aligned openings.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
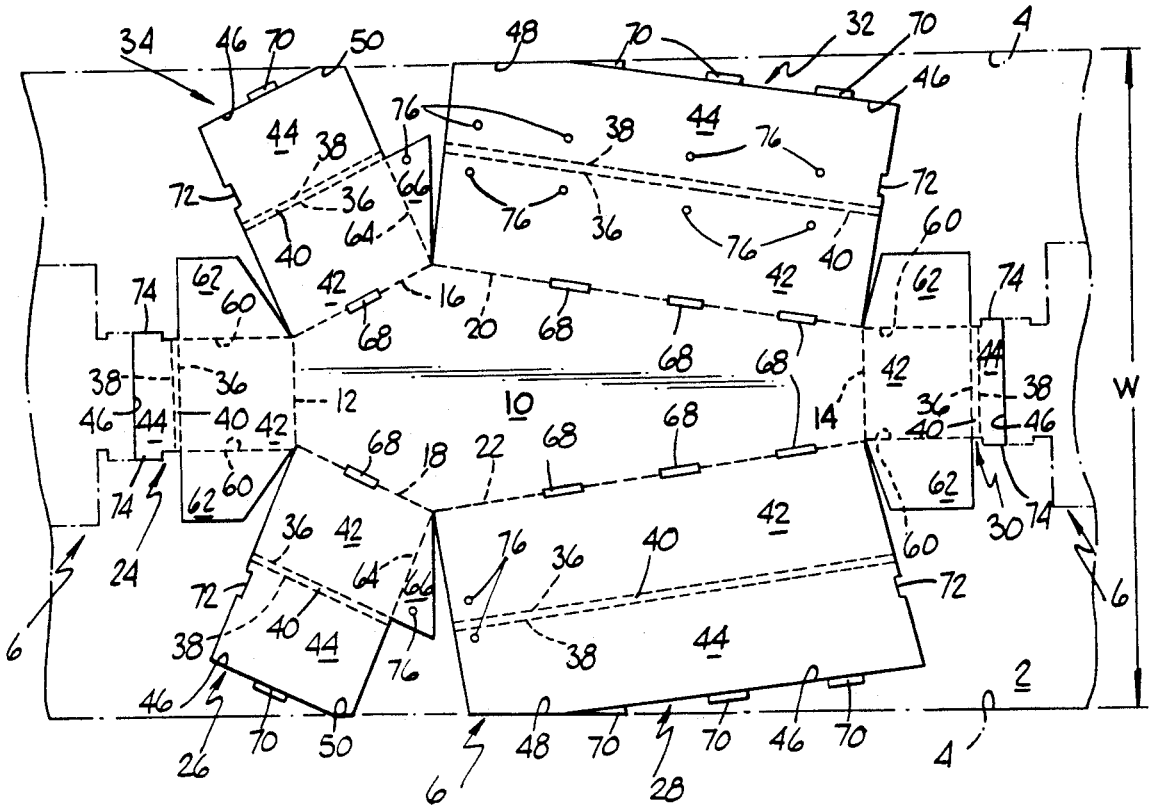
FIG. 1 is a top plan view illustrating a cut and scored cardboard blank of this invention being cut and scored from a continuous sheet of the cardboard.
Figure 2:
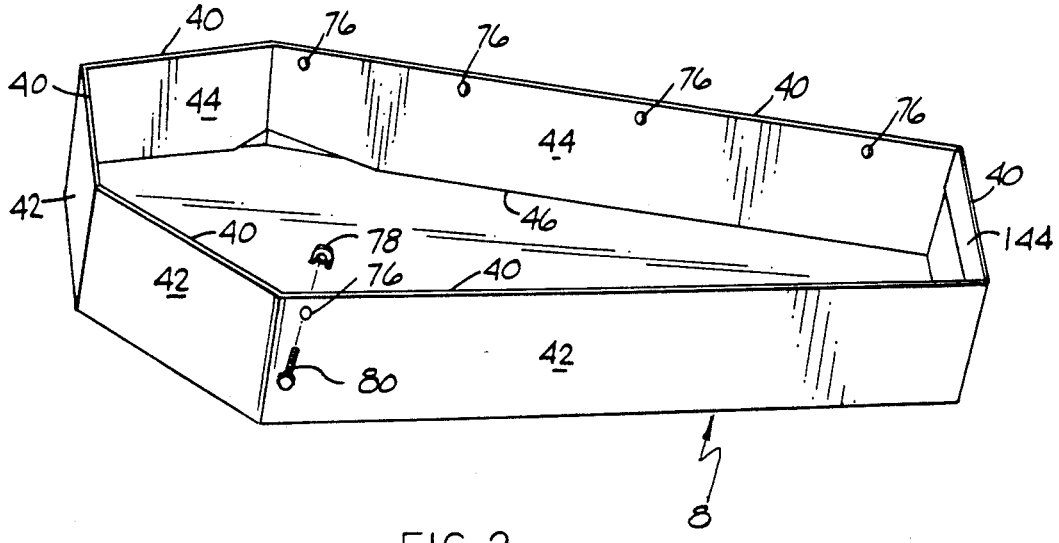
FIG. 2 is a perspective view of the cardboard blank of FIG. 1 folded into a coffin.

In FIG. 1, there is illustrated a continuous sheet 2 of material selected from the group comprising cardboard, corrugated cardboard, fiber board or other materials having similar characteristics and having edge portions 4 defining a predetermined width W therebetween. In the preferred embodiment, the continuous sheet 2 is a single ply corrugated cardboard panel such as that marketed by Colorado Container Co. and has a thickness of about 0.125 inch and a bursting strength of about 200 pounds and is black in color on at least one side thereof. The continuous sheet 2 is pulled by suitable conventional means (not shown) from a roll of the corrugated cardboard (not shown) over a conventional support structure (not shown) where it is cut and scored by suitable conventional apparatus (not shown) to form successive blanks 6 each of which is formed into coffins 8 as described below.

Each blank 6 comprises a central body portion 10 having a length greater than its width and having a central lengthwise extending longitudinal axis. The central body portion 10 is defined by a plurality of linear score lines comprising a pair of spaced apart linear score lines 12 and 14 extending in a direction transverse to the longitudinal axis of the central body portion 10; a pair of spaced apart relatively short linear score lines 16 and 18 extending in a direction inclined to the longitudinal axis of the central body portion 10 and a pair of spaced apart relatively long linear score lines 20 and 22 extending in a direction inclined to the longitudinal axis of the central body portion 10. As illustrated in FIG. 1, the linear score lines 20 and 22 are inclined relative to the longitudinal axis in a direction opposite to the inclination of the linear score lines 16 and 18.

A plurality of integral generally rectangularly shaped portions 24, 26, 28, 30, 32 and 34 extend outwardly from the linear score lines 12, 14, 16, 18, 20 and 22 so that they may be folded around the linear score lines to form sidewalls for the coffin 6 as described below. Each of the integral generally rectangularly shaped portions 24–34 has a pair of spaced apart linear score lines 36 and 38 so that an edge portion 40, as described below, is formed therebetween. The linear score lines 36 and 38 are parallel respectively to the linear score lines 12–22 so that the integral generally rectangularly shaped portions 24–34 may be folded around the linear score lines 36 and 38 to form the sections 42 and 44 thereof which, when folded, are in juxtaposed relationship. Each of the sections 44 has an exposed edge portion 46. The exposed edge portions 46 of the integral generally rectangularly shaped portions 28 and 32 have linear segments 48 in parallel relationship with each other and coinciding with the edge portions 4 defining the predetermined width W to provide the central body portion 10 with as greatest width as possible from the predetermined width W of the continuous sheet 2 of material. Also, the exposed edge portions 46 of the integral generally rectangularly shaped portions 26 and 34 have linear segments 50 in parallel relationship with each other and coinciding with the edge portions 4 defining the predetermined width W for the same purpose as the linear segments 48.

The sections 42 of the integral generally rectangularly shaped portions 24 and 30 are provided with linear score lines 60 to form integral lateral extensions 62 which are folded around the linear score lines 60 for purposes described below. The sections 42 of the integral generally rectangularly shaped portions 26 and 34 are provided with linear score lines 64 to form integral lateral extensions 66 which are folded around the score lines 64 for purposes described below. A plurality of spaced apart generally rectangularly shaped openings 68 are formed in the blank 6 and a plurality of spaced apart projections 70 extending outwardly from the edge portions 46 of the integral generally rectangularly shaped portions 26, 28, 32 and 34 for purposes described below. A plurality of spaced apart cut-out portions 72 are formed in the sections 44 of the integral generally rectangularly shaped portions 26, 28, 32 and 34 and a plurality of spaced apart projections 74 extend outwardly from the sections 44 of the integral generally rectangularly shaped portions 24 and 30 for purposes described below. A plurality of spaced apart openings 76 are provided in the blank 6 for purposes described below.

Figure 3:
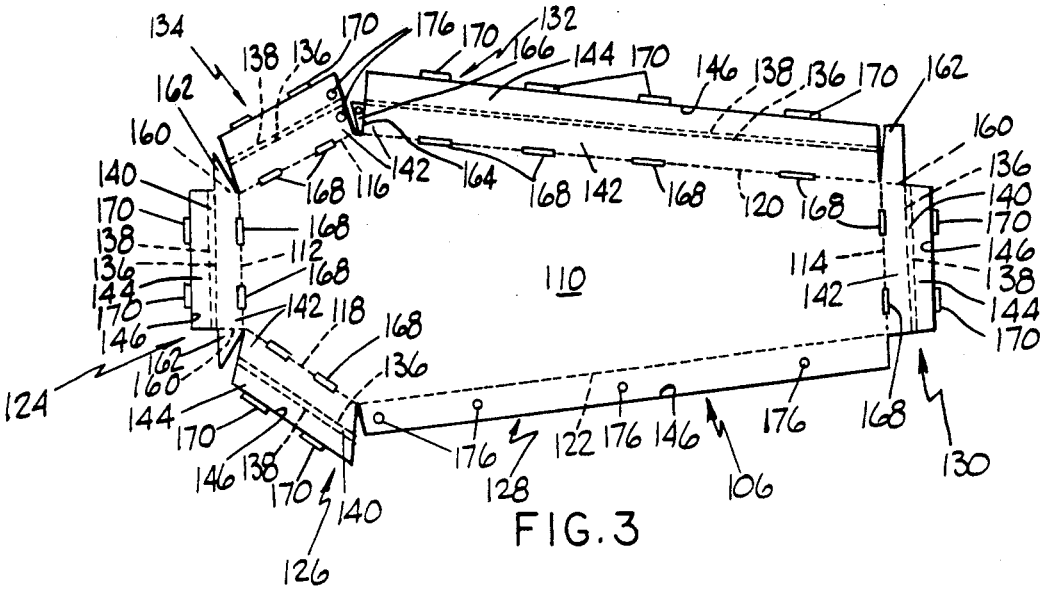
FIG. 3 is a top plan view illustrating a cut and scored cardboard blank of this invention.
Figure 4:
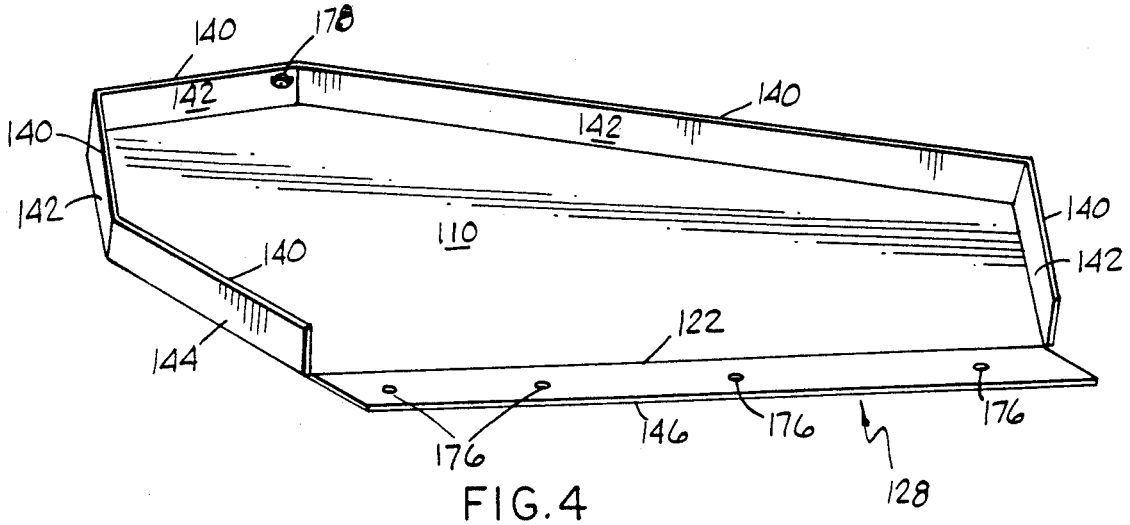
FIG. 4 is a perspective view of the cardboard blank of FIG. 3 folded into a lid for the coffin.
Figure 5:
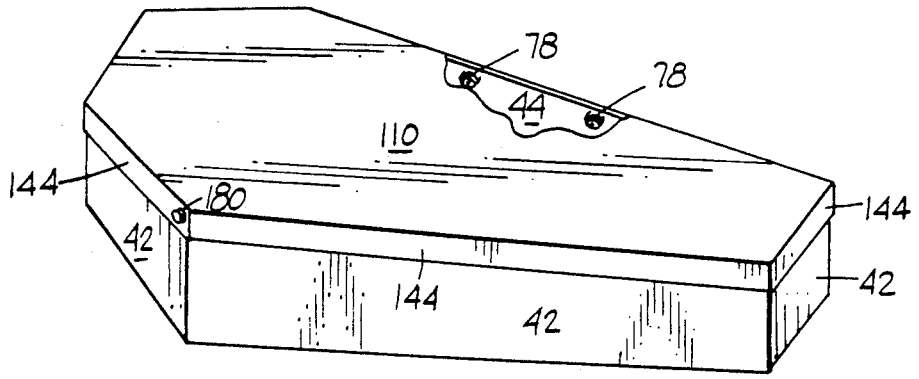
FIG. 5 is a perspective view of the assembled cardboard coffin and lid.

In FIG. 3, there is illustrated a blank 106 which is formed into a lid 108 for the coffin 8 as described below and formed from a sheet of material selected from the group comprising cardboard, corrugated cardboard, fiber board or other materials having similar characteristics and having edge portions 4 defining a predetermined width W therebetween. In the preferred embodiment, the sheet is a single ply corrugated cardboard panel such as that marketed by Colorado Container Co. and has a thickness of about 0.125 inch and a bursting strength of about 200 pounds and is black in color on at least one side thereof.

Each blank 106 comprises a central body portion 110 which is similar to but slightly greater than the central body portion 10. The central body portion 110 is defined by a plurality of linear score lines comprising a pair of spaced apart linear score lines 112 and 114 extending in a direction transverse to the longitudinal axis of the central body portion 110; a pair of spaced apart relatively short linear score lines 116 and 118 extending in a direction inclined to the longitudinal axis of the central body portion 110 and a pair of spaced apart relatively long linear score lines 120 and 122 extending in a direction inclined to the longitudinal axis of the central body portion 110. As illustrated in FIG. 3, the linear score lines 120 and 122 are inclined relative to the longitudinal axis in a direction opposite to the inclination of the linear score lines 116 and 118.

A plurality of integral generally rectangularly shaped portions 124, 126, 128, 130, 132 and 134 extend outwardly from the linear score lines 112, 114, 116, 118, 120 and 122 so that they may be folded around the linear score lines to form sidewalls for the lid 108 as described below. Each of the integral generally rectangularly shaped portions 124, 126 and 130–134 has a pair of spaced apart linear score lines 136 and 138 so that an edge portion 140, as described below, is formed therebetween. The linear score lines 136 and 138 are parallel respectively to the linear score lines 112–120 so that the integral generally rectangularly shaped portions 124, 126 and 130–134 may be folded around the linear score lines 136 and 138 to form the sections 142 and 144 thereof which, when folded, are in juxtaposed relationship. Each of the sections 144 has an exposed edge portion 146. Also, the integral generally rectangularly shaped portion 128 has an exposed edge portion 146.

The sections 142 of the integral generally rectangularly shaped portions 124 and 130 are provided with linear score lines 160 to form integral lateral extensions 162 which are folded around the linear score lines 160 for purposes described below. The sections 142 of the integral generally rectangularly shaped portions 132 is provided with linear score lines 164 to form integral lateral extensions 166 which is folded around the score lines 164 for purposes described below. A plurality of spaced apart generally rectangularly shaped openings 168 are formed in the blank 106 and a plurality of spaced apart projections 170 extending outwardly from the edge portions 146 of the integral generally rectangularly shaped portions 124, 126 and 130–134 for purposes described below. A plurality of spaced apart openings 176 are provided in the blank 6 for purposes described below.

The coffin 8 is formed by folding the blank 6 in the following manner. The blank 6 is laid on a flat surface (not shown) and the various components are folded around each score line for 180 degrees to ensure that it will be easy to fold the various components when forming the coffin 8. The sections 42 of the integral generally rectangularly shaped portions 26, 30 and 34 are folded around the linear score lines 14, 16 and 18, and the integral lateral extensions 62 and 66 thereof are partially folded around the linear score lines 60 and 64. The sections 42 are folded around the linear score lines 20 and 22 and then the sections 44 are folded around the linear score lines 36 and 38 so that the integral lateral extensions 62 and 66 are located between the juxtaposed sections 42 and 44. The projections 70 of the integral generally rectangularly shaped portions 28 and 32 are inserted into the generally rectangularly shaped openings 68. The integral lateral extensions 62 of the integral generally rectangularly shaped portion 24 are partially folded around the linear score lines 60 and the section 42 is folded around the linear score line 12. The sections 44 of the integral generally rectangularly shaped portions 26 and 34 are then folded around the linear score lines 36 and 38 so that the integral lateral extensions 62 are located between the juxtaposed sections 42 and 44. The projections 70 of the integral generally rectangularly shaped portions 26 and 34 are inserted into the generally rectangularly shaped openings 68. The sections 44 of the integral generally rectangularly shaped portions 24 and 3 are folded around the linear score lines 36 and 38 and the projections 74 are inserted into the cut out portions 72. A nut 78 having fastening tongs is positioned over the opening 76 in the section 44 of the integral generally rectangularly shaped portion 28 and a headed threaded bolt 80 is passed through the aligned opening 76 in the integral lateral extension 66 of the integral generally rectangularly shaped portion 26 and in the sections 42 and 44 of the integral generally rectangularly shaped portion 28 and threaded into the nut 78 to hold the coffin 8 in the assembled relationship.

The lid 108 is formed by folding the blank 106 in the following manner. The blank 106 is laid on the flat surface and folded around each score line for 180 degrees. The integral lateral extension 162 of the integral generally shaped portion 130 is partially folded around the linear score line 160 and the section 142 is folded around the linear score line 114. The section 142 of the integral generally rectangularly shaped portion 132 is folded around the linear score line 120 and the section 144 thereof is folded around the linear score lines 136 and 138 so that the integral lateral extension 162 is located between the juxtaposed sections 142 and 144. The projections 170 of the integral generally rectangularly shaped portion 132 are then inserted into the generally rectangularly shaped openings 168. The integral lateral extensions 162 of the integral generally rectangular section 124 are partially folded around the linear score line 160 and the section 142 thereof is folded around the linear score line 112. The sections 142 of the integral generally rectangularly shaped portions 126 and 134 are folded around the linear score lines 116 and 118 and then the sections 144 thereof are folded around the linear score lines 136 and 138 with the integral lateral extensions 162 located between the juxtaposed sections 142 and 144. The projections 170 thereof are then inserted into the generally rectangularly shaped openings 168. The sections 144 of the integral rectangularly shaped portions 124 and 130 are folded around the linear score lines 136 and 138 and the projections 170 thereof are inserted into the generally rectangularly shaped openings 168. A nut 178 is then secured around the opening 176 in the section 144 of the integral generally rectangularly shaped portion 134 and a headed threaded bolt 180 is passed through the aligned openings 176 in the sections 142 and the integral lateral extension 162 and threaded into the nut 178 to hold the lid 108 in the assembled relationship.

The lid 108 is assembled onto the coffin 8 in the following manner. A nut 78 is positioned over each opening 76 in the section 44 of the integral generally rectangularly shaped portion 32. The lid 108 is positioned over the coffin 8 and the integral generally rectangularly shaped portion 128 is folded over the linear score line 122 until the openings 176 therein are aligned with the openings 76 in the sections 42 and 44 of the integral generally rectangularly shaped portion 32. A headed threaded bolt 80 is then passed through each of the aligned openings 76 and 176 and threaded into the nuts 78 so that the lid 108 is hingedly connected to the coffin 8 so that it can be moved between opened and closed positions. The integral lateral extension 66 of the integral generally rectangularly shaped portion 34 is provided with an opening 76 that is aligned with the openings 76 in the integral generally rectangularly shaped portion 32 so that the threaded bolt also passes through the opening 76 in the integral lateral extension 66 to add further rigidity to the coffin 8.

It is contemplated that the inventive concepts herein described may be variously otherwise embodied and it is intended that the appended claims be construed to include the alternative embodiments of the invention except insofar as limited by the prior art.

What is claimed is:

1. A coffin constructed from a blank cut from a sheet of a material having edge portions defining a predetermined width and selected from the group comprising cardboard, corrugated cardboard, fiber board or other materials having similar characteristics, the blank comprising:

a central body portion having a length greater than its width and a lengthwise extending longitudinal axis;

said central body portion having a perimeter defined by a plurality of linear score lines comprising a pair of spaced apart parallel linear score lines extending in a direction transverse to said longitudinal axis, a pair of spaced apart relatively short linear score lines extending in a direction inclined to said longitudinal axis and a pair of spaced apart relatively long linear score lines extending in a direction inclined to said longitudinal axis;

a plurality of integral generally rectangularly shaped portions extending from said perimeter of said central body portion so that each of said integral rectangularly shaped portions may be folded around one of said linear score lines to form sidewalls for said coffin;

each of said plurality of generally rectangularly shaped portions having at least one score line parallel to one of said linear score lines defining said perimeter of said central body portion so that each of said generally rectangularly shaped portions may be folded around said at least one score line to form juxtaposed sections;

each of said integral generally rectangularly shaped portions having an exposed edge portion; and said exposed edge portions of said generally rectangularly shaped portions extending from said pair of relatively long linear score lines having linear segments thereof in a parallel relationship with each other and said longitudinal axis and coinciding with the edge portions defining the predetermined width of said sheet of material to provide said central body portion with a greatest width as possible from said predetermined width of said sheet of material.

2. The invention as in claim 1 and further comprising:

said exposed edge portions of said generally rectangularly shaped portions extending from said pair of relatively short linear score lines having linear segments thereof in a parallel relationship with each other and said longitudinal axis and coinciding with the edge portions defining the predetermined width of said sheet of material to provide said central body portion with as greatest width as possible from said predetermined width of said sheet of material.

3. The invention as in claim 2 and further comprising:

at least some of said plurality of integral rectangularly shaped portions having score lines defining integral lateral extensions so that when said blank is folded around said score lines, each of said lateral extensions will be located between said juxtaposed sections of a next adjacent one of said rectangularly shaped portions.

4. The invention as in claim 3 and further comprising:

fastening means for securing one of said lateral extensions between said next adjacent one of said juxtaposed sections so that all of said folded integral generally rectangularly shaped portions are held in said folded relationship.

5. The invention as in claim 4 wherein said fastening means comprises:

said one of said lateral extensions having an opening formed therein;

said next adjacent one of said folded juxtaposed sections having openings formed therein and aligned with said opening in said one lateral extension; and said fastening means extending through said aligned openings.

6. The invention as in claim 1 wherein:

said at least one score line in each of the integral generally rectangularly shaped portions comprising a pair of spaced apart score lines to that an edge portion is formed between said spaced apart score lines when said integral generally rectangularly shaped portions are folded around said spaced apart score lines.

7. The invention as in claim 1 and further comprising:

another cardboard blank for forming a lid for said cardboard coffin comprising a flat cardboard sheet having a central body portion, having a length greater than its width and a lengthwise extending longitudinal axis, and having a perimeter defined by a plurality of linear score lines similar to but slightly larger than said perimeter of said central body portion of said coffin portion;

a plurality of integral generally rectangularly shaped portions extending from said perimeter of said central body portion of the lid so that each of said integral generally rectangularly shaped portions may be folded around one of said linear score lines to form sidewalls for said lid; and mounting means for hingedly mounting one of said sidewalls of said lid on one of said sidewalls of said coffin so that said lid may be readily moved between closed or opened positions.

8. The invention as in claim 7 wherein:

a plurality of said plurality of integral generally rectangularly shaped portions for forming said sidewalls of said lid having at least one score line parallel to one of said linear score lines defining said perimeter of said central body portion of said lid so that each of said plurality of said plurality of said integral generally rectangularly shaped portions may be folded around said at least one score line to form juxtaposed sections.

9. The invention as in claim 8 and further comprising:

at least some of said plurality of integral generally rectangularly shaped portions of said lid having score lines defining integral lateral extensions so that when said blank is folded around said score lines, each of said lateral extensions will be located between said juxtaposed sections of a next adjacent one of said integral generally rectangularly shaped portions;

fastening means for securing one of said lateral extensions between said next adjacent one of said juxtaposed sections so that all of said folded integral generally rectangularly shaped portions are held in said folded relationship; and said fastening means comprising:

said one of said lateral extensions having an opening formed therein;

said next adjacent one of said folded juxtaposed sections having openings formed therein and aligned with said opening in said one lateral extension; and said fastening means extending through said aligned openings.

10. The invention as in claim 9 wherein:

said at least one score line comprising a pair of spaced apart score lines so that an edge portion is formed between said spaced apart score lines when said integral rectangularly shaped portions are folded around said spaced apart score lines.

11. The invention as in claim 9 wherein said mounting means comprises:

one of said integral generally rectangularly shaped portions of said lid having a plurality of openings formed therein;

said juxtaposed sections of one of said integral generally rectangularly shaped portions of said coffin having a plurality of aligned openings formed therein;

said integral lateral extension of said coffin located between said juxtaposed sections, having an opening aligned with said aligned opening in said juxtaposed sections;

said opening in said one of said integral generally rectangularly shaped portion of said lid being aligned with said aligned openings in said juxtaposed sections and said integral lateral extension when said lid is positioned over said coffin to form a plurality of sets of aligned openings; and fastening means passing through each of said plurality of aligned sets of openings.

* * * * *